US005974796A

United States Patent [19]

Ishikawa et al.

[11] Patent Number: 5,974,796

[45] Date of Patent: Nov. 2, 1999

[54] HYDRAULIC CIRCUIT SYSTEM FOR HYDRAULIC WORKING MACHINE

[75] Inventors: Kouji Ishikawa, Tsuchiura; Genroku Sugiyama, Ibaraki-ken; Tsukasa Toyooka, Ibaraki-ken; Tsuyoshi Nakamura, Ibaraki-ken, all of Japan

[73] Assignee: Hitachi Construction Machinery Co., Ltd., Tokyo, Japan

[21] Appl. No.: 08/987,709

[22] Filed: Dec. 9, 1997

[30] Foreign Application Priority Data

Dec. 10, 1996 [JP] Japan ..... 8-329876

[51] Int. Cl.[6] ..... F16D 31/02

[52] U.S. Cl. ..... 60/399; 60/445; 60/452

[58] Field of Search ..... 60/399, 445, 452

[56] References Cited

U.S. PATENT DOCUMENTS

| | | | |
|---|---|---|---|
| 2,455,837 | 12/1948 | Waldie | 60/452 |
| 3,971,216 | 7/1976 | Miller | 60/452 |
| 4,730,543 | 3/1988 | Holmes | 60/399 |
| 4,838,755 | 6/1989 | Johnson et al. . | |

FOREIGN PATENT DOCUMENTS

| | | | |
|---|---|---|---|
| 214 633 | 3/1987 | European Pat. Off. . | |
| 432 266 | 6/1991 | European Pat. Off. . | |
| 62-26630 | 7/1987 | Japan . | |
| 5-57052 | 7/1993 | Japan . | |
| 6-28304 | 4/1994 | Japan . | |
| 1287630 | 9/1972 | United Kingdom | 60/445 |
| 2 291 987 | 2/1996 | United Kingdom . | |

*Primary Examiner*—F. Daniel Lopez
*Attorney, Agent, or Firm*—Beall Law Offices

[57] ABSTRACT

A regulator (20) comprises a servo piston 21 and a tilting control valve (22) which is made up of a spool (22*a*), a spring (22*b*), a control piston (22*d*) and a first pressure bearing chamber (22*e*). With these components, the regulator (20) controls a pump tilting such that a pump delivery rate is reduced as delivery pump pressure rises. The tilting control valve (22) also includes a second pressure bearing chamber (22*f*). When a gate-lock lever (31) is operated to switch over a lock valve (30), a flow control valve (6) is disabled from operating not to move even if a control lever (11*a*) is erroneously touched, and the machine is surely kept from coming into operation. At the same time, pilot primary pressure from a pilot pump (3) is introduced to the second pressure bearing chamber (22*f*) of the tilting control valve (22), causing the pump tilting to reduce down to a minimum tilting ($q_{min}$). In the inoperative condition where the operator has no intention of carrying out work, it is thus possible to minimize the tilting of the hydraulic pump and reduce an energy loss.

7 Claims, 14 Drawing Sheets

HYDRAULIC CIRCUIT SYSTEM FOR HYDRAULIC WORKING MACHINE

BACKGROUND OF THE INVENTION

1. Field of the Invention

The present invention relates to a hydraulic circuit system for hydraulic working machines such as hydraulic excavators, and more particularly to a hydraulic circuit system for hydraulic working machines provided with a safety control device, e.g., a lock valve, which is operated upon a gate-lock lever manipulated by an operator when the operator has no intention of carrying out work, for cutting off pilot primary pressure from a control lever unit.

2. Description of the Related Art

A hydraulic circuit system for hydraulic working machines such as hydraulic excavators generally comprises a variable displacement hydraulic pump driven by a prime mover (engine), and flow control valves for supplying and returning a hydraulic fluid from the hydraulic pump to and from actuators. When any of control levers of control lever units is operated, a command signal in the form of pilot pressure, for example, is applied to the associated flow control valve, whereupon the flow control valve is driven to shift in position to operate the actuator.

Also, the hydraulic circuit system includes a regulator as tilting control means for controlling a tilting of the hydraulic pump and hence controlling a delivery flow rate of the pump. There are various types of regulators. One example of regulators which has an input torque limiting function is designed to receive the delivery pressure of the hydraulic pump, and when the pump delivery pressure becomes high, to make smaller a pump tilting to reduce a delivery flow rate so that the pump absorbing torque will not exceed the output torque of the prime mover driving the hydraulic pump. This surely prevents the prime mover from stalling even when the pump delivery pressure is so high. The prior art related to the regulator having an input torque limiting function is disclosed in, e.g., JP, Y, 62-26630.

In a hydraulic circuit system having a center bypass line by which flow control valves of the center bypass type are connected in series, a negative control type regulator is employed which detects a center bypass flow rate in terms of pressure and controls the pump tilting in accordance with the detected pressure. The negative control type regulator is designed to make smaller the pump tilting to reduce the delivery flow rate when the center bypass flow rate is large and the detected pressure is high, but to make larger the pump tilting to increase the delivery flow rate when the center bypass flow rate is small and the detected pressure is low, thereby delivering a pump flow rate depending on the flow rate demanded by the flow control valve to reduce an energy loss.

Also, in the negative control type regulator, the tilting of the hydraulic pump is generally controlled such that when the control levers are not operated and the flow control valves are in the neutral positions, a certain flow rate larger than a minimum flow rate is maintained as a stand-by flow rate to improve response of actuators at the start-up of operation. The prior art related to the regulator performing the negative control and setting the stand-by flow rate is disclosed in, e.g., JP, U, 6-28304.

Meanwhile, in hydraulic working machines such as hydraulic excavators, a lock valve is provided as safety control means to keep the machine from coming into operation even if a control lever is erroneously touched when the operator has no intention of carrying out work in such an occasion as getting off the machine. The lock valve is disposed in a pilot line through which the pilot primary pressure is supplied from a pilot pump to a pilot valve of a control lever unit. When a gate-lock lever is operated, the lock valve is shifted to cut off the pilot primary pressure, whereby the pilot secondary pressure, i.e., the command pilot pressure, is output in no way from the pilot valve even with the control lever moved. As a result, erroneous operation of the machine is prevented. The prior art related to the lock valve is disclosed in, e.g., JP, U, 5-57052.

SUMMARY OF THE INVENTION

The conventional hydraulic circuit system however has a problem that when the gate-lock lever is operated to activate the lock valve, the hydraulic pump has a large tilting and the energy loss is large in spite of the condition where the operator has no intention of carrying out work.

More specifically, in the regulator having an input torque limiting function, when the control levers are not operated and the flow control valves are in the neutral positions, the pump delivery pressure is usually at a minimum level and therefore the pump tilting is controlled to have a maximum value as a result of the input torque limiting function. Also, in the negative control type regulator, when the control levers are not operated and the flow control valves are in the neutral positions, the pump tilting is controlled to provide a stand-by flow rate larger than a minimum flow rate, as mentioned above, for an improvement of response in the start-up operation. Therefore, although the operator manipulates the gate-lock lever to activate the lock valve and cut off the pilot primary pressure with no intention of carrying out work, the hydraulic pump continues delivering the maximum flow rate or the stand-by flow rate, resulting in a large energy loss.

An object of the present invention is to provide a hydraulic circuit system for a hydraulic working machine which can make smaller a tilting of a hydraulic pump and reduce an energy loss in the inoperative condition where the operator has no intention of carrying out work.

(1) To achieve the above object, according to the present invention, there is provided a hydraulic circuit system for a hydraulic working machine comprising a variable displacement hydraulic pump driven by a prime mover, first tilting control means for controlling the displacement of the hydraulic pump, a flow control valve for supplying and returning a hydraulic fluid from the hydraulic pump to and from an actuator, operation control means for driving the flow control valve to shift in position by a command signal, and safety control means provided in the operation control means and being able to cut off a generation/-transmission path of the command signal, wherein the hydraulic circuit system further comprises second tilting control means for controlling the displacement of the hydraulic pump in interlock with the operation of the safety control means.

With the present invention constructed as set forth above, when the operator has no intention of carrying out work and manipulates the safety control means, the generation/transmission path of the command signal for the flow control valve is cut off and erroneous operation of the machine is prevented. At the same time, the second tilting control means is operated to control the displacement of the hydraulic pump in interlock with the operation of the safety control means. In the inoperative condition where the operator has no intention of carrying out work, it is therefore possible to make smaller a tilting of the hydraulic pump and reduce an energy loss. (2) In the above system of (1), preferably, the second tilting control means controls the displacement of the hydraulic pump to reduce in interlock with the operation of the safety control means.

As with the above system, this feature also makes it possible to make smaller a tilting of the hydraulic pump and reduce an energy loss.

(3) In the above system of (1), preferably, when the generation/transmission path of the command signal is cut off by the safety control means, the second tilting control means controls the displacement of the hydraulic pump to become smaller than the displacement provided by the first tilting control means when the generation/-transmission path of the command signal is not cut off and the flow control valve is in a neutral position.

As with the above system, this feature also makes it possible to make smaller a tilting of the hydraulic pump and reduce an energy loss in the inoperative condition where the operator has no intention of carrying out work.

(4) In the above system of (1), the first tilting control means is, e.g., means for controlling the displacement of the hydraulic pump to reduce as delivery pressure of the hydraulic pump rises. In this case, preferably, the second tilting control means controls the displacement of the hydraulic pump in interlock with the operation of the safety control means to become smaller than the displacement provided by the first tilting control means when the delivery pressure of the hydraulic pump is at the lowest level.

With this feature, the first tilting control means can effect the so-called input torque limiting control function, while the tilting of the hydraulic pump can be made smaller and the energy loss can be reduced in the inoperative condition where the operator has no intention of carrying out work.

(5) In the above system of (1), the first tilting control means is, e.g., means for controlling the displacement of the hydraulic pump in accordance with a flow rate demanded by the flow control valve and, when the flow control valve is in a neutral position, controlling the displacement of the hydraulic pump to provide a stand-by flow rate larger than a minimum flow rate of the hydraulic pump. In this case, preferably, the second tilting control means controls the displacement of the hydraulic pump in interlock with the operation of the safety control means to become smaller than the displacement at which the standby flow rate is provided.

With this feature, response at the start-up of operation of the actuator can be improved in the system wherein the first tilting control means comprises a regulator of the so-called negative or positive control type, while the tilting of the hydraulic pump can be made smaller and the energy loss can be reduced in the inoperative condition where the operator has no intention of carrying out work.

(6) In any of the above systems (2) to (5), preferably, the second tilting control means controls the displacement of the hydraulic pump in interlock with the operation of the safety control means to take a minimum value of the displacement in the range achievable by the hydraulic pump.

With this feature, an energy loss can be reduced to minimum in the inoperative condition where the operator has no intention of carrying out work.

(7) In any of the above systems (1) to (6), preferably, the operation control means is pilot-operated means for producing command pilot pressure, as the command signal, by using pressure from a pilot hydraulic pressure source as primary pressure, and the safety control means comprises a gate-lock lever to be manipulated when an operator has no intention of carrying out work, and a lock valve operated upon the gate-lock lever being manipulated by the operator, for cutting off the primary pressure from the pilot hydraulic pressure source.

DESCRIPTION OF THE PREFERRED EMBODIMENTS

Several embodiments of the present invention will be described hereunder with reference to the drawings.

Figure 1:
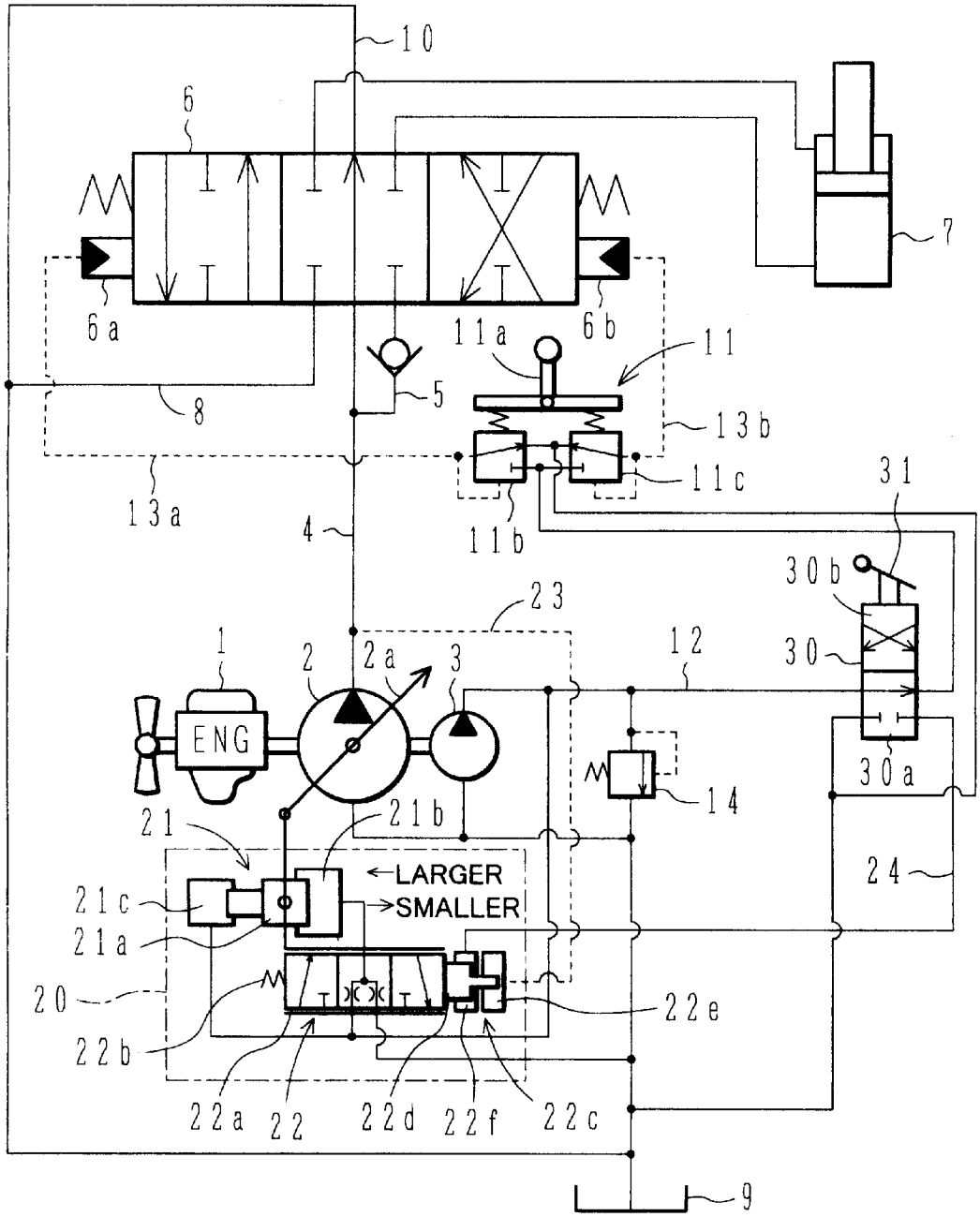
FIG. 1 is a diagram showing a hydraulic circuit system according to a first embodiment of the present invention.
Figure 2:
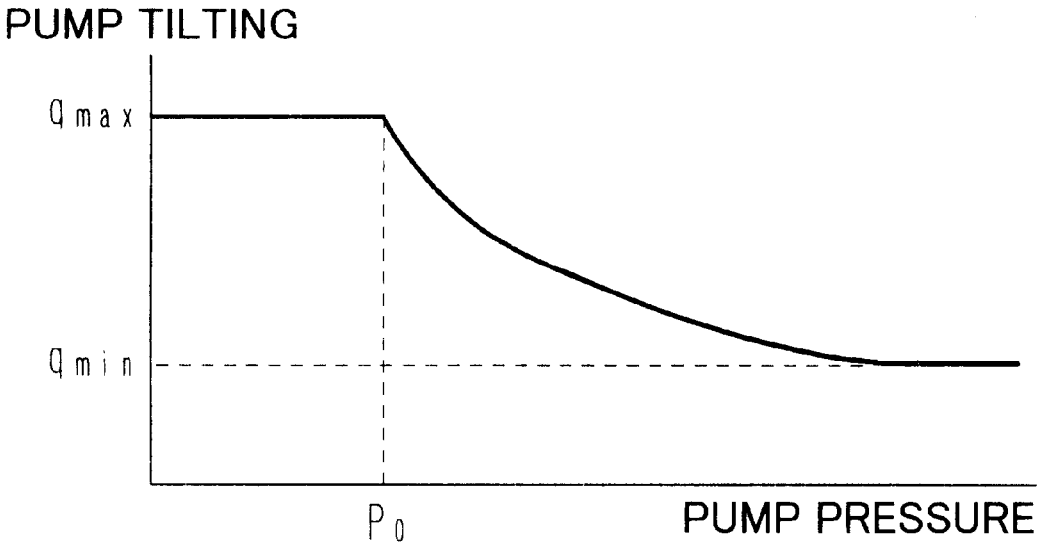
FIG. 2 is a graph showing the relationship between pump pressure and a pump tilting established by a regulator.

The following description begins by explaining a first embodiment of the present invention with reference to FIGS. 1 and 2.

In FIG. 1, denoted by reference numeral 1 is a prime mover (engine) which drives a variable displacement main hydraulic pump (hereinafter referred to also as a main pump) 2 and a fixed displacement pilot pump 3.

A hydraulic fluid delivered from the main pump 2 is supplied to an actuator, e.g., a hydraulic cylinder 7, via a delivery line 4, a supply line 5 and a flow control valve 6, whereas a return hydraulic fluid from the hydraulic cylinder 7 is returned to a reservoir 9 via a return line 8.

The flow control valve 6 is of the center bypass type with a center bypass line 10 penetrating through it. The center bypass line 10 has an upstream end connected to the delivery line 4 and a downstream end connected to the reservoir 9.

When the flow control valve 6 is in the neutral position as shown, a center bypass throttle of the flow control valve 6 is fully opened, but meter-in and meter-out variable throttles of the flow control valve 6 are fully closed, causing all the hydraulic fluid delivered from the main pump 2 to return to the reservoir 9 through the center bypass line 10. When the flow control valve 6 is moved from the shown position to take the left-hand position, for example, as viewed in the drawing, an opening area of the center bypass throttle of the flow control valve 6 is reduced and the meter-in and meter-out variable throttles are opened depending on a shift amount by which the flow control valve 6 has moved. This reduces the flow rate of the hydraulic fluid passing through the center bypass line 10 and raises the delivery pressure of the main pump 2 under the action of the center bypass throttle, enabling the hydraulic fluid to be supplied to the bottom side of the hydraulic cylinder 7. Accordingly, the hydraulic cylinder 7 is operated in the extending direction at a speed corresponding to the shift amount of the flow control valve 6. Likewise, when the flow control valve 6 is moved to take the right-hand position as viewed in the drawing, the hydraulic fluid is supplied to the rod side of the hydraulic cylinder 7 and the hydraulic cylinder 7 is operated in the contracting direction at a speed corresponding to the shift amount of the flow control valve 6. In this manner, the operating speed and the operating direction of the hydraulic cylinder 7 is controlled upon movement of the flow control valve 6.

Further, the flow control valve 6 is a pilot-operated valve driven to move upon receiving, as a command signal, pilot pressure from a control lever unit 11. The control lever unit 11 comprises a control lever 11*a* and one pair of pilot valves 11*b,* 11*c*. The pilot valves 11*b,* 11*c* have primary side ports connected to a delivery port of the pilot pump 3 via a pilot line 12, and secondary side ports connected respectively to driving sectors 6*a,* 6*b* of the flow control valve 6 via pilot lines 13*a,* 13*b*. A pilot relief valve 14 is connected to the pilot line 12 for determining delivery pressure of the pilot pump 3, i.e., pilot primary pressure.

When the control lever 11*a* is turned downward to the left as viewed in the drawing, the pilot valve 11*b* is operated to produce, on the basis of the pilot primary pressure from the pilot pump 3, pilot secondary pressure corresponding to a shift amount by which the control lever 11*a* has been operated. The pilot secondary pressure is sent as command pilot pressure to the driving sector 6*a* of the flow control valve 6 for switching over the flow control valve 6 to the left-hand position as viewed in the drawing. When the control lever 11*a* is turned downward, on the contrary, to the right as viewed in the drawing, the pilot valve 11*c* is operated and the command pilot pressure corresponding to a shift amount by which the control lever 11*a* has been operated is likewise sent to the driving sector 6*b* of the flow control valve 6 for switching over the flow control valve 6 to the right-hand position as viewed in the drawing.

The hydraulic pump 2 is a swash plate pump wherein a delivery flow rate (capacity) per revolution can be adjusted by changing the tilting angle (displacement) of a swash plate 2*a*. The tilting angle of the swash plate 2*a* is controlled by a tilting controller, i.e., a regulator 20.

The regulator 20 is a regulator having an input torque limiting function and comprises a servo piston 21 and a tilting control valve 22.

The servo piston 21 has a differential piston 21*a* which is driven based on a difference in pressure bearing area between the opposite sides. The differential piston 21*a* has a large-diameter side pressure bearing chamber 21*b* connected to the pilot line 12 and the reservoir 9 via the tilting control valve 22, and a small-diameter side pressure bearing chamber 21*c* directly connected to the pilot line 12. Due to the difference in pressure bearing area between the opposite sides, the differential piston 21*a* is moved to the left as viewed in the drawing when the large-diameter side pressure bearing chamber 21*b* is communicated with the pilot line 12, and it is moved to the right as viewed in the drawing when the large-diameter side pressure bearing chamber 21*b* is communicated with the reservoir 9. With the differential piston 21*a* moved to the left as viewed in the drawing, the tilting angle of the swash plate 2*a,* i.e., the pump tilting, is augmented to increase the delivery flow rate of the hydraulic pump 2. With the differential piston 21*a* moved to the right as viewed in the drawing, the pump tilting is diminished to reduce the delivery flow rate of the hydraulic pump 2.

The tilting control valve 22 is a valve used for input torque limiting control and comprises a spool 22*a,* a spring 22*b,* and a shift driving sector 22*c*. The shift driving sector 22*c* includes a control piston 22*d,* a first pressure bearing chamber 22*e* and a second pressure bearing chamber 22*f*. The first pressure bearing chamber 22*e* is connected to the delivery line 4 via a pilot line 23 for being supplied with the pressure from the delivery line 4 (i.e., the delivery pressure of the hydraulic pump 2), and the second pressure bearing chamber 22*f* is connected to the lock valve 30 via a pilot line 24 for being selectively supplied with the pilot primary pressure from the pilot pump 3 (as described later).

In the condition where the pilot primary pressure from the pilot pump 3 is not supplied to the second pressure bearing chamber 22*f* of the tilting control valve 22 through the lock valve 30, the tilting control valve 22 controls the communication of the large-diameter side pressure bearing chamber 21*b* of the servo piston 21 with the pilot line 12 and the reservoir 9 depending on the pressure from the delivery line 4 (i.e., the delivery pressure of the hydraulic pump 2). Thus, the tilting control valve 22 performs the input toque limiting control such that as the delivery pressure of the hydraulic pump 2 increases, the pump tilting is reduced.

More specifically, if the delivery pressure of the hydraulic pump 2 is not higher than the level $P_0$ set by the spring 22*b,* the spool 22*a* is moved to the right as viewed in the drawing, whereupon the large-diameter side pressure bearing chamber 21*b* of the servo piston 21 is communicated with the pilot line 12 to increase the pump tilting. If the delivery pressure of the hydraulic pump 2 becomes higher than the level $P_0$ set by the spring 22*b,* the spool 22*a* is moved to the left as viewed in the drawing, whereupon the large-diameter side pressure bearing chamber 21*b* of the servo piston 21 is communicated with the reservoir 9 to reduce the pump tilting. Accordingly, as shown in FIG. 2, when the delivery pressure of the hydraulic pump 2 is not higher than the set value $P_0$, the pump tilting takes a maximum tilting $q_{max}$ in the range achievable by the hydraulic pump 2, and when the delivery pressure of the hydraulic pump 2 is higher than the set value $P_0$, the pump tilting is gradually reduced down to a minimum tilting $q_{min}$ in the range achievable by the hydraulic pump 2 as the pump delivery pressure rises.

Here, the maximum tilting $q_{max}$ and the minimum tilting $q_{min}$ in the range achievable by the hydraulic pump 2 means, respectively, a maximum tilting and a minimum tilting determined beforehand as specifications of the hydraulic pump 2 from the structural point of view. The swash plate 2*a* of the hydraulic pump 2 cannot tilt over the maximum tilting $q_{max}$ or below the minimum tilting $q_{min}$ due to structural limitations. Additionally, the minimum tilting $q_{min}$ of the hydraulic pump 2 is set so as to deliver the hydraulic fluid at a very small flow rate for the purposes of self-lubrication, etc. when the hydraulic pump 2 is in the neutral state, and therefore set to a very small tilting larger than zero.

By controlling the pump tilting as explained above, the delivery flow rate of the hydraulic pump 2 is reduced as the pump delivery pressure rises, so that the pump absorbing torque will not exceed the output torque of the prime mover driving the hydraulic pump. As a result, the prime mover is surely prevented from stalling even when the pump delivery pressure is so high.

When the pilot primary pressure from the pilot pump 3 is introduced to the second pressure bearing chamber 22*f* of the tilting control valve 22 through the lock valve 30, the spool 22*a* of the tilting control valve 22 is forcibly moved to the left as viewed in the drawing regardless of whether the pump delivery pressure introduced to the first pressure bearing chamber 22*e* is high or low, whereupon the large-diameter side pressure bearing chamber 21*b* of the servo piston 21 is communicated with the reservoir 9, causing the pump tilting to reduce down to the minimum tilting $q_{min}$.

The lock valve 30 is disposed in the pilot line 12, and has a first position 30*a* where the lock valve 30 communicates the pilot pump 3 with the primary side ports of the pilot valves 11*b*, 11*c* of the control lever unit 11, but cuts off the pilot pump 3 from the communication with the second pressure bearing chamber 22*f* of the tilting control valve 22, and a second position 30*b* where the lock valve 30 communicates the primary side ports of the pilot valves 11*b*, 11*c* of the control lever unit 11 with the reservoir 9, and communicates the pilot pump 3 with the second pressure bearing chamber 22*f* of the tilting control valve 22. The lock valve 30 is switched over by a gate-lock lever 31 to selectively take one of the first and second positions 30*a*, 30*b*.

The gate-lock lever 31 is to keep the machine from coming into operation even if the control lever is erroneously touched when an operator has no intention of carrying out work in such an occasion as getting off the machine. While the machine is in the operative condition with the operator having intent to carry out work, the gate-lock lever 31 is not manipulated and the lock valve 30 is held in the first position 30*a* as shown. When the machine is brought into the inoperative condition with the operator having no intent to carry out work, the gate-lock lever 31 is manipulated and the lock valve 30 is switched over to the second position 30*b*.

In the foregoing arrangements, the servo piston 21 and the tilting control valve 22 of the regulator 20, as well as the spool 22*a*, the spring 22*b*, the control piston 22*d* and the first pressure bearing chamber 22*e* of the tilting control valve 22 jointly constitute first tilting control means for controlling the displacement of the hydraulic pump 2. The pilot pump 3, the control lever unit 11 and the pilot lines 12, 13*a*, 13*b* jointly constitute operation control means for driving the flow control valve 6 to shift in position by a command signal. The lock valve 30 and the gate-lock lever 31 jointly constitute safety control means provided in the operation control means and being able to cut off a generation/-transmission path of the command signal.

Further, the servo piston 21 and the tilting control valve 22 of the regulator 20, as well as the spool 22*a*, the control piston 22*d*, the second pressure bearing chamber 22*f* and the pilot line 24 of the tilting control valve 22 jointly constitute second tilting control means for controlling the displacement of the hydraulic pump 2 in interlock with the operation of the safety control means.

The operation of the first embodiment having the above-described construction will be explained below.

First, when the operator has the intention of carrying out work, the gate-lock lever 31 is not manipulated and the lock valve 30 is held in the first position 30*a*. In this condition, the pilot pressure is generated upon the control lever 11*a* being manipulated by the operator, and the operator can perform work in a normal way by manipulating the control lever 11*a*.

Then, when the operator has no intention of carrying out work in such an occasion as getting off the machine, the gate-lock lever 31 is manipulated and the lock valve 30 is switched over to the second position 30*b*. Upon the switching of the lock valve 30 from the first position 30*a*, shown in the drawing, to the second position 30*b*, the pilot primary pressure introduced to the pilot valves 11*b*, 11*c* is cut off and hence no pressures are output from the pilot valves 11*b*, 11*c* even with the control lever 11*a* operated. As a result, even if the control lever is erroneously touched, the flow control valve 6 is not moved and the machine is surely kept from coming into operation.

Further, in such a condition where the gate-lock lever 31 is manipulated and the lock valve 30 is switched over to the second position 30*b*, the flow control valve 6 is not moved and held in the neutral position as shown. Therefore, the center bypass throttle is fully opened and the delivery pressure of the hydraulic pump 2 is as low as close to the reservoir pressure. In the conventional hydraulic control system, when the gate-lock lever 31 is manipulated likewise, the low pump delivery pressure is only introduced to the first pressure bearing chamber 22*e* of the tilting control valve 22, causing the tilting of the hydraulic pump to increase. Accordingly, even in the condition where the operator has no intention of carrying out work, the hydraulic pump continues delivering the hydraulic fluid at a large flow rate, resulting in a large energy loss.

In this embodiment, as stated above, when the gate-lock lever 31 is manipulated and the lock valve 30 is switched over to the second position 30*b*, the pilot primary pressure from the pilot pump 3 is introduced to the second pressure bearing chamber 22*f* of the tilting control valve 22. This forcibly moves the spool 22*a* of the tilting control valve 22 to the left as viewed in the drawing, whereupon the large-diameter side pressure bearing chamber 21*b* of the servo piston 21 is communicated with the reservoir 9, causing the pump tilting to reduce down to the minimum tilting $q_{min}$. Accordingly, in the inoperative condition where the operator has no intention of carrying out work, the delivery flow rate of the hydraulic pump can be minimized and the energy loss can be reduced.

Figure 3:
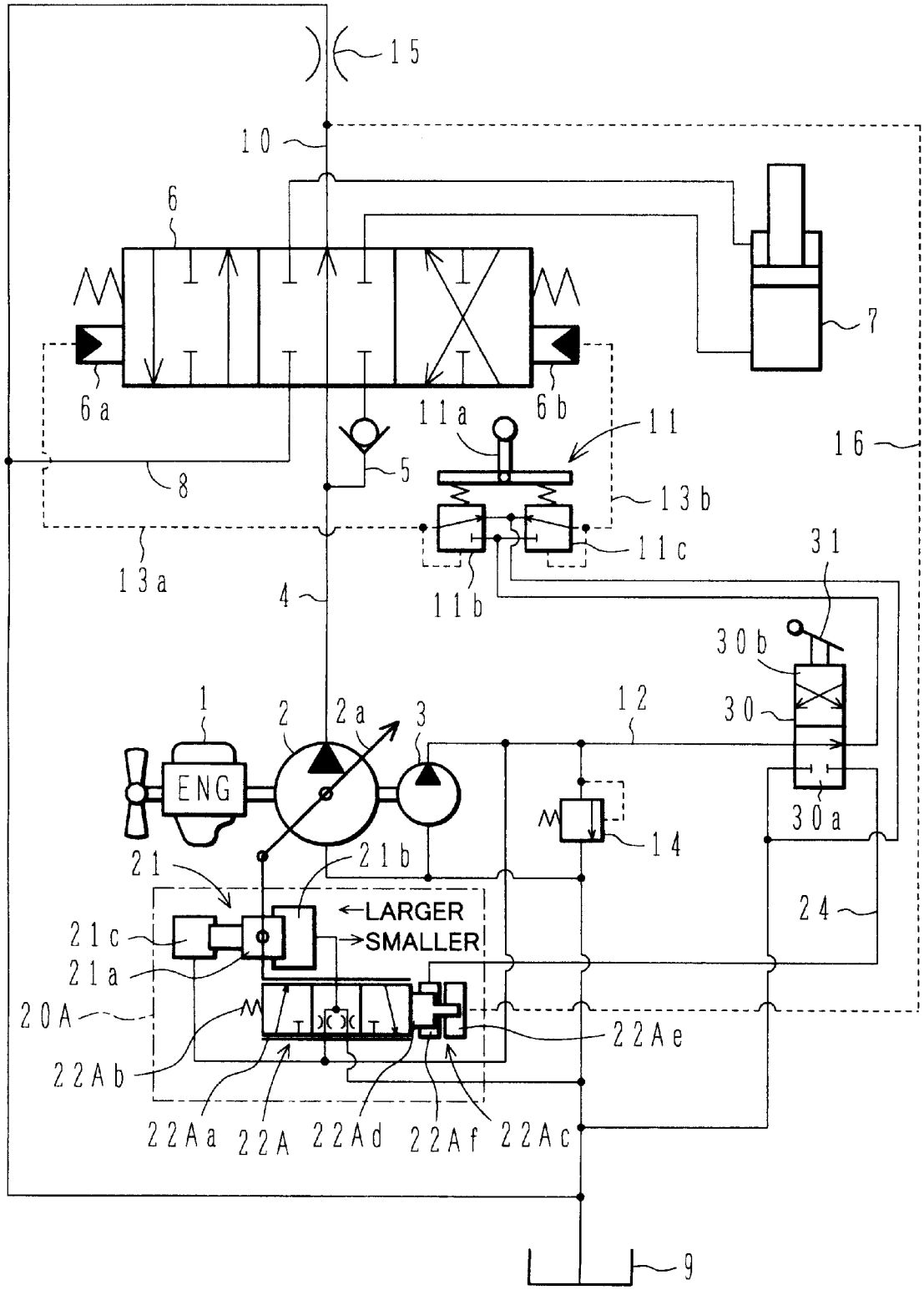
FIG. 3 is a diagram showing a hydraulic circuit system according to a second embodiment of the present invention.

A second embodiment of the present invention will be described with reference to FIGS. 3 to 6. In FIG. 3, the same members as those shown in FIG. 1 are denoted by the same reference numerals. While in the first embodiment the present invention is applied to the hydraulic circuit system which includes the regulator 20 having an input torque limiting function, the present invention is applied to a hydraulic circuit system including a negative control type regulator in this second embodiment.

In FIG. 3, a throttle 15 is disposed in the center bypass line 10 downstream of the flow control valve 6 and serves to convert the flow rate of the hydraulic fluid passing through the center bypass line 10 (i.e., the center bypass flow rate) into pressure.

Figure 4:
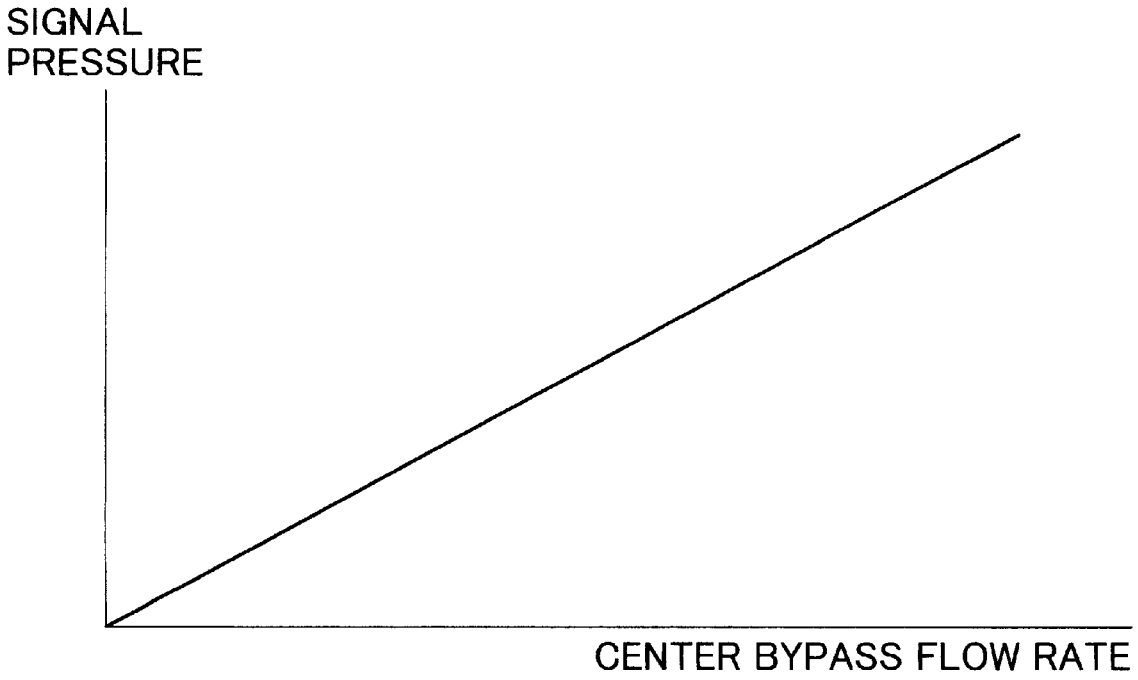
FIG. 4 is a graph showing the relationship between a center bypass flow rate and signal pressure.

FIG. 4 shows the relationship, established by the throttle 15, between the center bypass flow rate and the pressure (signal pressure) upstream of the throttle 15. The signal pressure lowers as the center bypass flow rate decreases.

A regulator 20A is a negative control type regulator which receives, as an external command, the pressure converted by the throttle 15 and controls the pump tilting in accordance with the received pressure. A first pressure bearing chamber 22A*e* of the tilting control valve 22A is connected to the center bypass line 10 upstream of the throttle 15 via a signal line 16 for being supplied with, as signal pressure, the pressure produced by the throttle 15 through conversion from the flow rate. The second pressure bearing chamber 22A*f* of the tilting control valve 22A is connected to the lock valve 30 via the pilot line 24 for being selectively supplied with the pilot primary pressure from the pilot pump 3 in a like manner as in the first embodiment.

In the condition where the pilot primary pressure from the pilot pump 3 is not introduced to the second pressure bearing chamber 22A*f* of the tilting control valve 22A through the lock valve 30, when the signal pressure introduced to the first pressure bearing chamber 22A*e* is higher than the pressure level set by a spring 22A*b*, a spool 22A*a* is moved to the left as viewed in the drawing, whereupon the large-diameter side pressure bearing chamber 21*b* of the servo piston 21 is communicated with the reservoir 9 to reduce the pump tilting. If the signal pressure becomes lower than the pressure level set by the spring 22A*b*, the spool 22A*a* is moved to the right as viewed in the drawing, whereupon the large-diameter side pressure bearing chamber 21*b* of the servo piston 21 is communicated with the pilot line 12 to increase the pump tilting. As a result, the pump tilting is controlled to increase with a lowering of the signal pressure, as shown in FIG. 5.

On the other hand, as shown in FIG. 4, the pressure (signal pressure) upstream of the throttle 15 lowers as the center bypass flow rate decreases. Consequently, as shown in FIG. 6, the pump tilting increases as the center bypass flow rate decreases.

As explained above, the regulator 20A performs control in such a manner that when the center bypass flow rate is large and the signal pressure is high, the pump tilting is diminished to reduce the delivery flow rate of the hydraulic pump 2, and when the center bypass flow rate is small and the signal pressure is low, the pump tilting is augmented to increase the delivery flow rate of the hydraulic pump 2. Thus, the regulator 20A enables the pump flow rate to be delivered depending on the flow rate demanded by the flow control valve 6, thereby reducing an energy loss.

Figure 5:
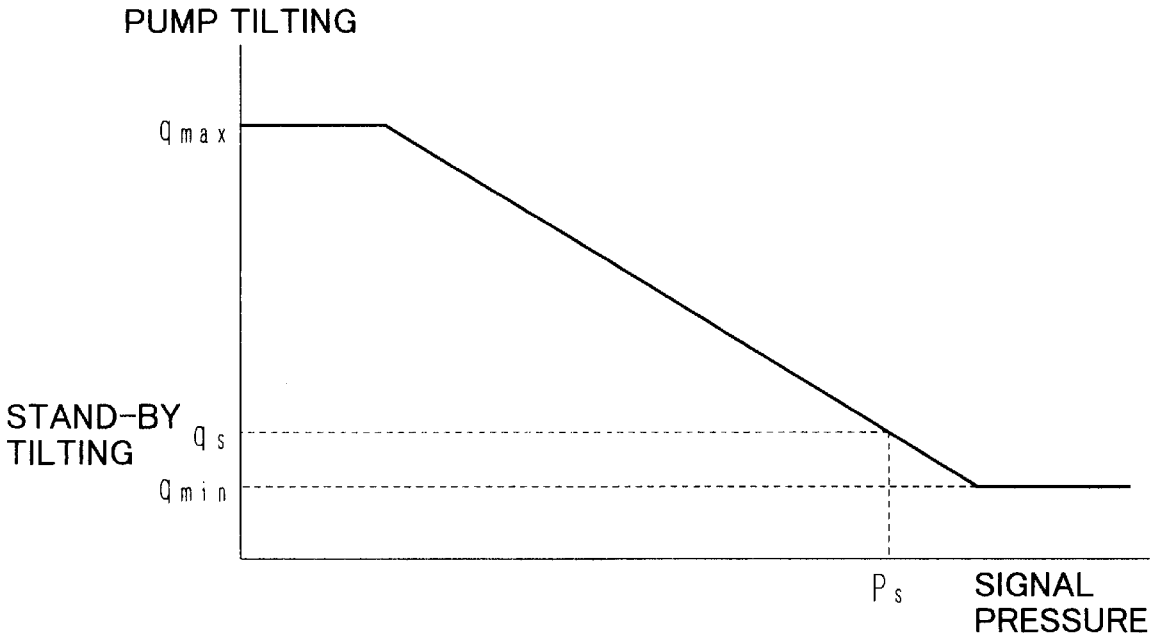
FIG. 5 is a graph showing the relationship between the signal pressure and a pump tilting established by a regulator.
Figure 6:
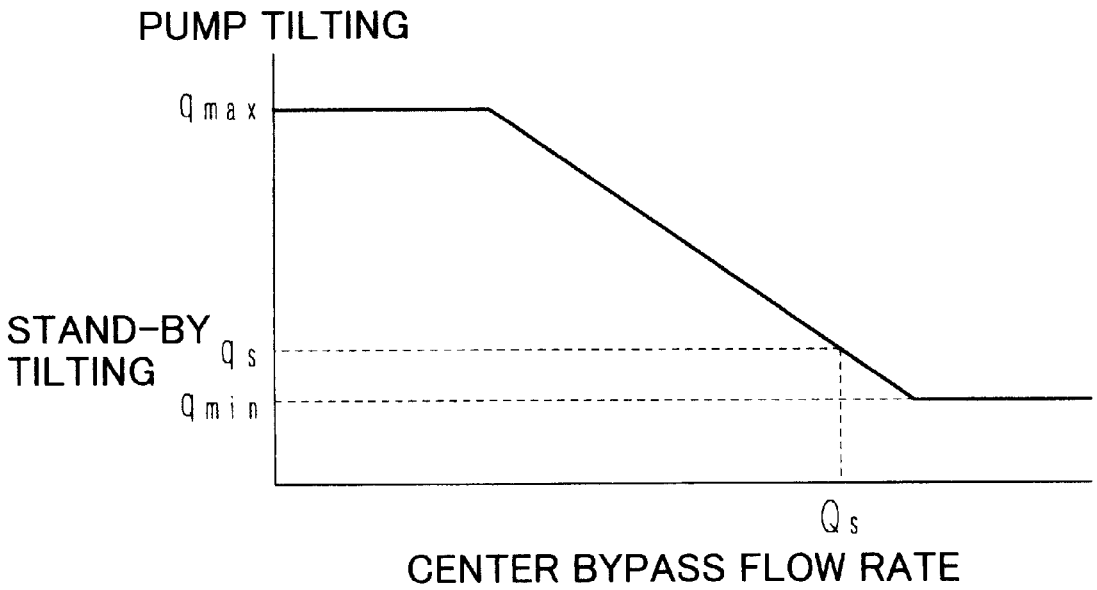
FIG. 6 is a graph showing the relationship between a center bypass flow rate and the pump tilting established by the regulator.

Furthermore, in FIGS. 5 and 6, Ps and Qs represent the signal pressure and the center bypass flow rate, respectively, resulted when the flow control valve 6 is in the neutral position and the center bypass throttle is fully opened. The spring 22A*b* of the tilting control valve 22A and the pressure bearing area of the control piston 22A*d* thereof are set such that a stand-by tilting $q_s$ which is slightly larger than the minimum tilting $q_{min}$ in the range achievable by the hydraulic pump 2 is provided at the signal pressure of Ps. Accordingly, when the control lever 11*a* is not operated and the flow control valve 6 is in the neutral position, a certain flow rate larger than a minimum flow rate is maintained as a stand-by flow rate to improve response of the associated actuator at the start-up of operation.

The operation of the second embodiment having the above-described construction will be explained below.

First, when the operator has the intention of carrying out work, the gate-lock lever 31 is not manipulated and the lock valve 30 is held in the first position 30*a*. In this condition, the pilot pressure is generated upon the control lever 11*a* being manipulated by the operator, and the operator can perform work in a normal way by manipulating the control lever 11*a*.

Then, when the operator has no intention of carrying out work in such an occasion as getting off the machine, the gate-lock lever 31 is manipulated and the lock valve 30 is switched over to the second position 30*b*. Upon the switching of the lock valve 30 from the first position 30*a* to the second position 30*b*, the pilot primary pressure introduced to the pilot valves 11*b*, 11*c* is cut off and hence no pressures are output from the pilot valves 11*b*, 11*c* even with the control lever 11*a* operated. As a result, even if the control lever is erroneously touched, the flow control valve 6 is not moved and the machine is surely kept from coming into operation.

Further, in such a condition where the gate-lock lever 31 is manipulated and the lock valve 30 is switched over to the second position 30*b*, the flow control valve 6 is not moved and held in the neutral position as shown. Therefore, the center bypass throttle is fully opened and the signal pressure Ps is produced upstream of the throttle 15. In the conventional hydraulic control system, when the gate-lock lever 31 is manipulated likewise, the signal pressure Ps is only introduced to the first pressure bearing chamber 22A*e* of the tilting control valve 22A for controlling the tilting of the hydraulic pump to take the stand-by tilting $q_s$. Accordingly, even in the condition where the operator has no intention of carrying out work, the hydraulic pump continues delivering the extra hydraulic fluid at the stand-by flow rate, resulting in a large energy loss.

In this embodiment, as stated above, when the gate-lock lever 31 is manipulated and the lock valve 30 is switched over to the second position 30*b*, the pilot primary pressure from the pilot pump 3 is introduced to the second pressure bearing chamber 22A*f* of the tilting control valve 22A. This forcibly moves the spool 22A*a* of the tilting control valve 22A to the left as viewed in the drawing, whereupon the large-diameter side pressure bearing chamber 21*b* of the servo piston 21 is communicated with the reservoir 9, causing the pump tilting to reduce down to the minimum tilting $q_{min}$. Accordingly, in the inoperative condition where the operator has no intention of carrying out work, the delivery flow rate of the hydraulic pump can be minimized and the energy loss can be reduced.

Figure 7:
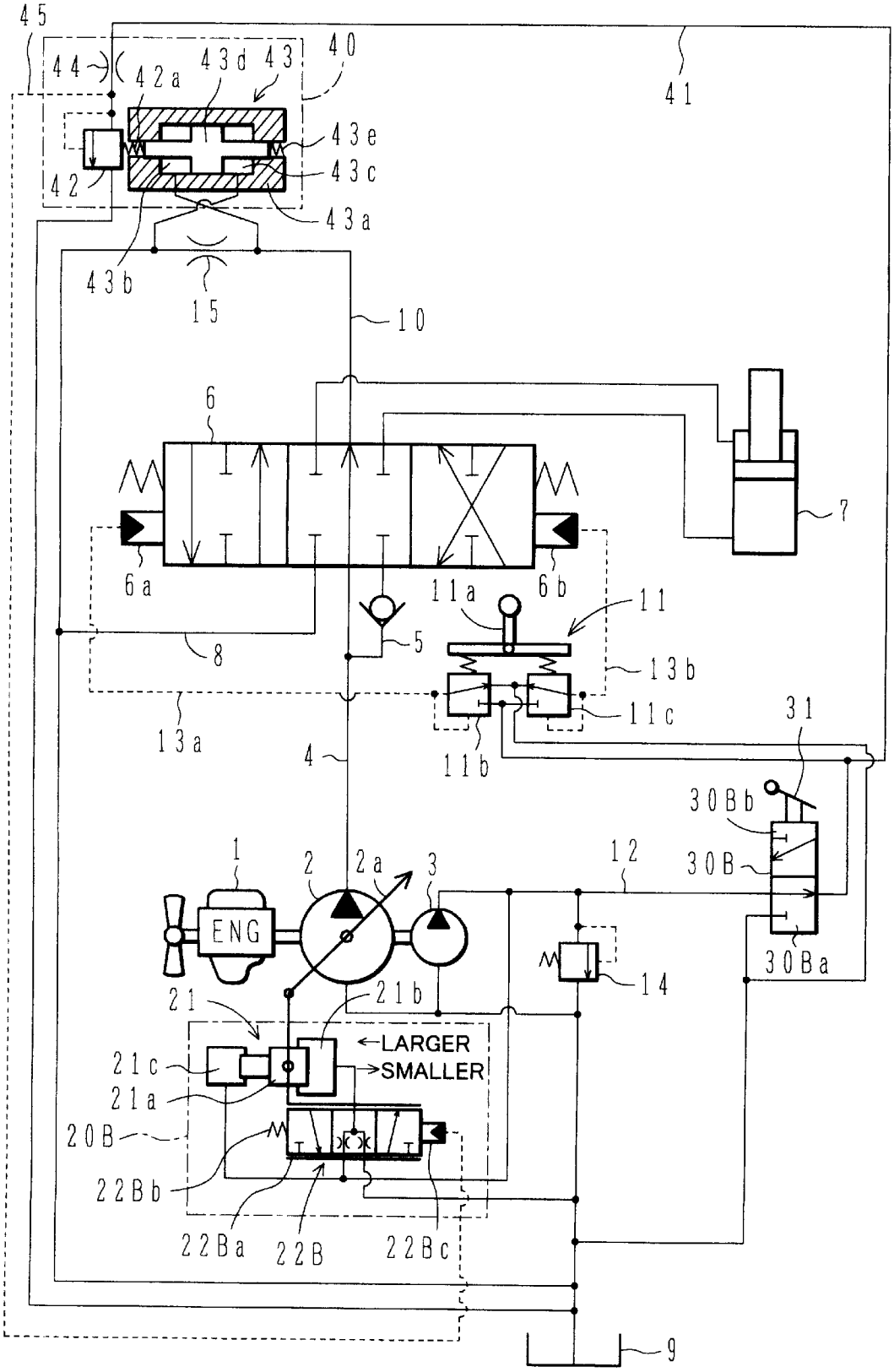
FIG. 7 is a diagram showing a hydraulic circuit system according to a third embodiment of the present invention.

A third embodiment of the present invention will be described with reference to FIGS. 7 to 9. In FIG. 7, the same members as those shown in FIGS. 1 and 3 are denoted by the same reference numerals. In this third embodiment, the present invention is applied to a hydraulic circuit system which employs a positive control type regulator instead of the negative control type regulator.

In FIG. 7, similarly to the second embodiment, the throttle 15 is disposed in the center bypass line 10 downstream of the flow control valve 6 and serves to convert the center bypass flow rate into pressure. A flow rate reversing detector 40 is also disposed downstream of the flow control valve 6 as means for detecting the center bypass flow rate in terms of pressure converted in reversed relation between the two parameters. The flow rate reversing detector 40 comprises a pilot line 41 connected to the pilot line 12 on the output side of a lock valve 30B for being supplied with the pilot primary pressure, a variable relief valve 42 connected to the pilot line 41, a spool device 43 for operating the variable relief valve 42, and a throttle 44 disposed in the pilot line 41 upstream of the variable relief valve 42. The pressure developed between the variable relief valve 42 and the throttle 44 is detected as signal pressure through a signal line 45.

The spool device 43 has a piston type spool 43*d* disposed in a housing 43*a* to define pressure bearing chambers 43*b*, 43*c* within the housing space. The pressure bearing chambers 43*b,* 43*c* are connected respectively to the center bypass line 10 upstream and downstream of the throttle 15 so that the differential pressure produced across the throttle 15 depending on the center bypass flow rate acts upon opposite end surfaces of a piston of the spool 43*d.* Further, a spring 43*c* is disposed to exert a resilient force against one axial end of the spool 43*d* in the direction opposite to the pressure produced upstream of the throttle 15 and introduced to the pressure bearing chamber 43*b,* while a set spring 42*a* for the variable relief valve 42 is disposed to be held in engagement with the other axial end of the spool 43*d.*

When the center bypass flow rate is large and the differential pressure across the throttle 15 is high, the spool 43*d* is moved to the right as viewed in the drawing, thereby making weaker the force of the set spring 42*a* for the variable relief valve 42. This lowers the pressure generated by the variable relief valve 42. When the center bypass flow rate is reduced and the differential pressure across the throttle 15 becomes low, the spool 43*d* is moved to the left as viewed in the drawing, thereby making stronger the force of the set spring 42*a* for the variable relief valve 42. This raises the pressure generated by the variable relief valve 42.

Figure 8:
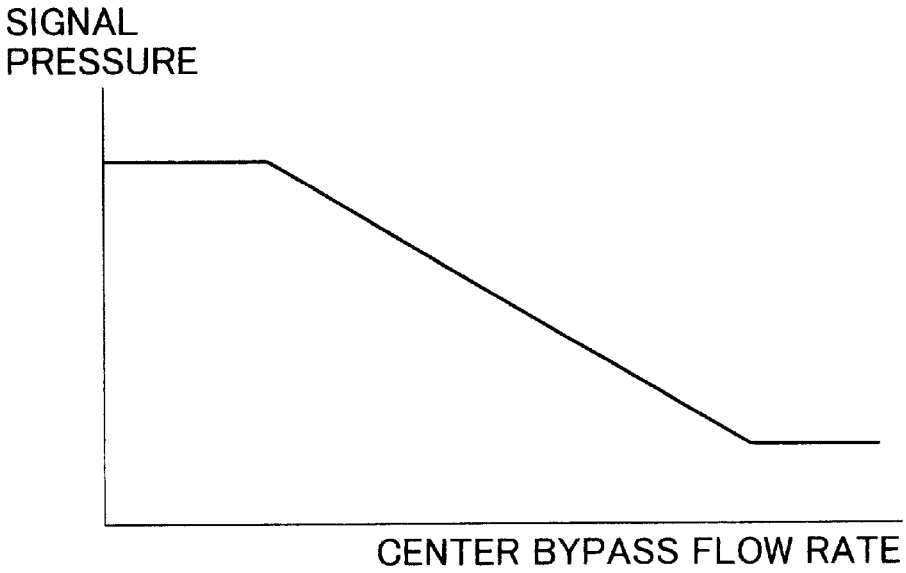
FIG. 8 is a graph showing the relationship between a center bypass flow rate and signal pressure.

FIG. 8 shows the relationship between the center bypass flow rate and the signal pressure established by the flow rate reversing detector 40. The signal pressure rises as the center bypass flow rate decreases.

The lock valve 30B is the same as conventional one, and is shifted by the gate-lock lever 31 to selectively take one of a first position 30B*a* where the lock valve 30B communicates the pilot pump 3 with the primary side ports of the pilot valves 11*b,* 11*c* of the control lever unit 11, and a second position 30B*b* where the lock valve 30B communicates the primary side ports of the pilot valves 11*b,* 11*c* of the control lever unit 11 with the reservoir 9.

Because the pilot line 41 is connected to the pilot line 12 on the output side of the lock valve 30B, the primary pressure supplied to the flow rate reversing detector 40 is changed in interlock with the switching of the lock valve 30B between the first and second positions 30B*a*, 30B*b*. Thus, when the lock valve 30 is switched over from the first position 30B*a*, shown in the drawing, to the second position 30B*b*, the pilot primary pressure supplied to the flow rate reversing detector 40 is given by the reservoir pressure.

A regulator 20B is a positive control type regulator which receives, as an external command, the signal pressure from the flow rate reversing detector 40 and controls the pump tilting in accordance with the received pressure. A tilting control valve 22B comprises a spool 22B*a*, a spring 22B*b*, and a shift driving sector 22B*c*. The shift driving sector 22B*c* is connected to the signal line 45 for being supplied with the signal pressure from the flow rate reversing detector 40.

The tilting control valve 22B operates as follows. When the signal pressure introduced to the shift driving sector 22B*c* is lower than the pressure level set by the spring 22B*b*, the spool 22B*a* is moved to the right as viewed in the drawing, whereupon the large-diameter side pressure bearing chamber 21*b* of the servo piston 21 is communicated with the reservoir 9 to reduce the pump tilting. If the signal pressure becomes higher than the pressure level set by the spring 22B*b*, the spool 22A*a* is moved to the left as viewed in the drawing, whereupon the large-diameter side pressure bearing chamber 21*b* of the servo piston 21 is communicated with the pilot line 12 to increase the pump tilting. As a result, the pump tilting is controlled to increase with a rise of the signal pressure, as shown in FIG. 9.

Figure 9:
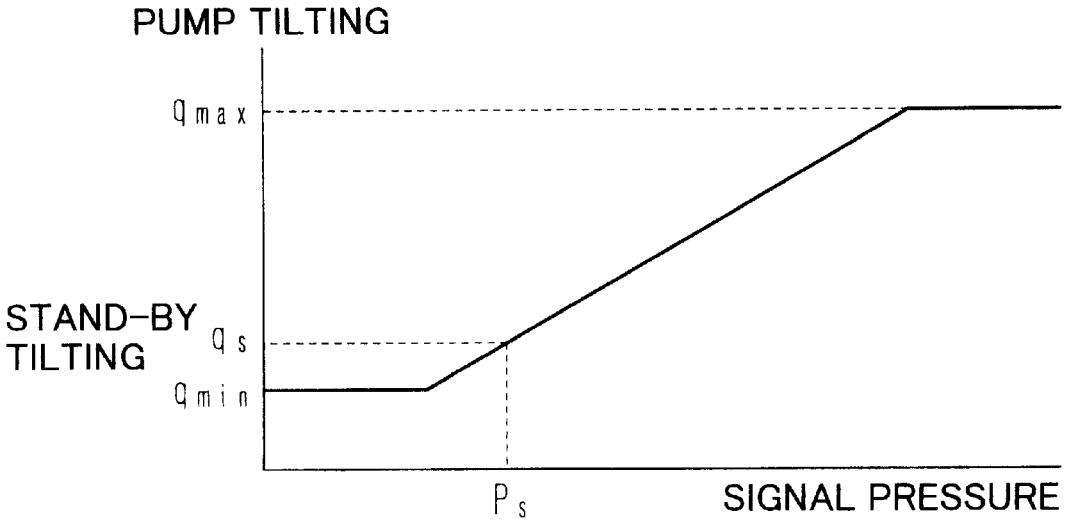
FIG. 9 is a graph showing the relationship between the signal pressure and a pump tilting established by a regulator.

Furthermore, in FIG. 9, Ps represents the signal pressure produced by the flow rate reversing detector 40 when the flow control valve 6 is in the neutral position and the center bypass throttle is fully opened. The spring 22B*b* of the tilting control valve 22B and the pressure bearing area of the shift driving sector 22B*c* thereof are set such that a stand-by tilting $q_s$ which is slightly larger than the minimum tilting $q_{min}$ in the range achievable by the hydraulic pump 2 is provided at the signal pressure of Ps. Accordingly, when the control lever 11*a* is not operated and the flow control valve 6 is in the neutral position, a certain flow rate larger than a minimum flow rate is maintained as a stand-by flow rate to improve response of the associated actuator at the start-up of operation.

Also in this third embodiment having the above-described construction, when the gate-lock lever 31 is not manipulated and the lock valve 30B is held in the first position 30B*a*, the operator can perform work in a normal way by manipulating the control lever 11*a*. But when the gate-lock lever 31 is manipulated and the lock valve 30B is switched over to the second position 30B*b*, the flow control valve 6 is disabled from operating not to move even if the control lever 11*a* is erroneously touched. At the same time, the signal pressure from the flow rate reversing detector 40 turns to the reservoir pressure and the spool 22B*a* of the tilting control valve 22B is forcibly moved to the right end position as viewed in the drawing under the action of the spring 22B*b*, causing the pump tilting to reduce down to the minimum tilting $q_{min}$ as shown in FIG. 9.

With this third embodiment, therefore, the similar advantages as obtainable with the first and second embodiments can also be provided in the hydraulic circuit system employing the positive control type regulator.

Figure 10:
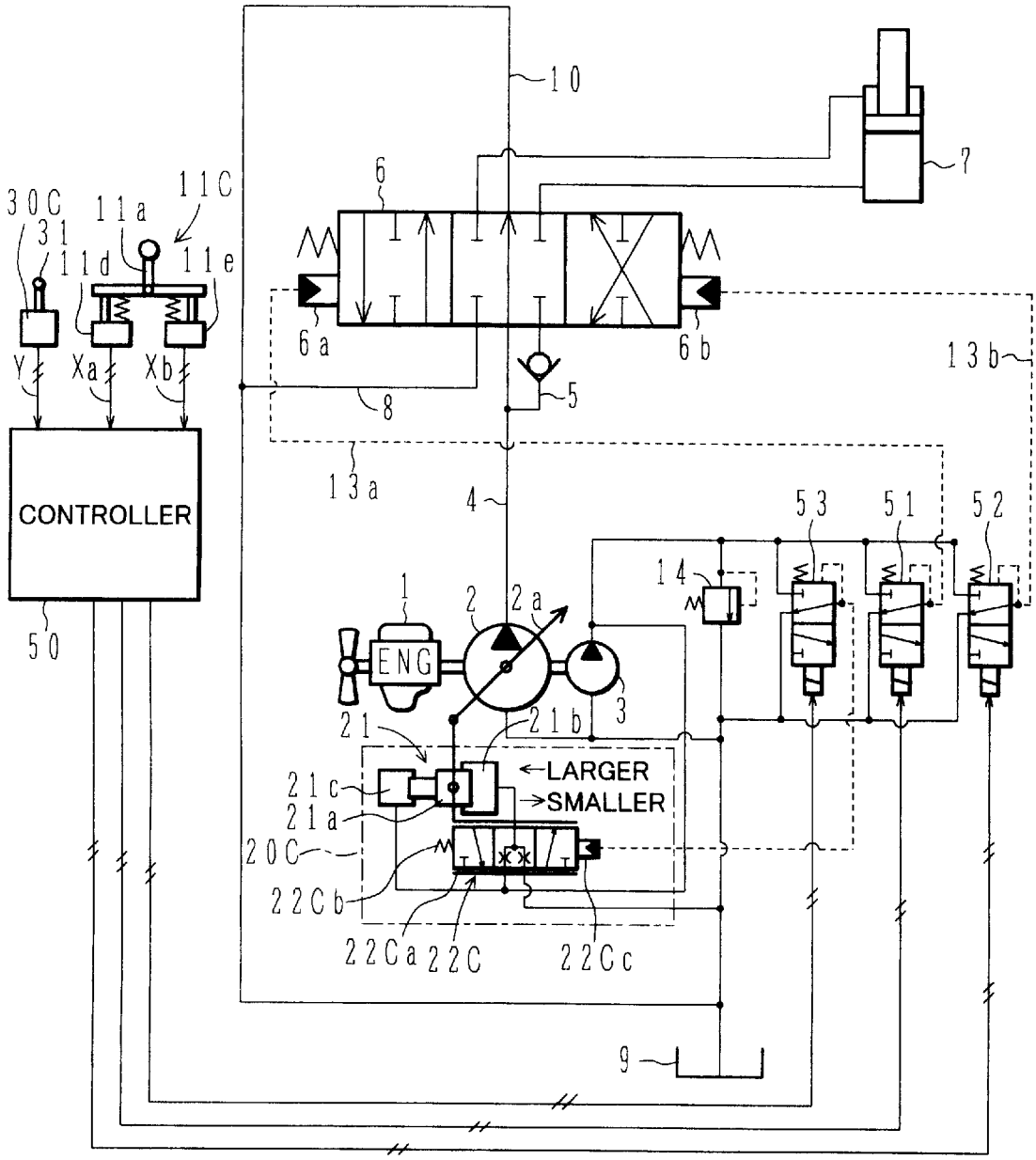
FIG. 10 is a diagram showing a hydraulic circuit system according to a fourth embodiment of the present invention.

A fourth embodiment of the present invention will be described with reference to FIGS. 10 to 14. In FIG. 10, the same members as those shown in FIGS. 1, 3 and 7 are denoted by the same reference numerals. In this fourth embodiment, the present invention is applied to a hydraulic circuit system in which command pressures applied to the flow control valve and the regulator are produced electrically.

In FIG. 10, denoted by 11C is a control lever unit of the electric lever type. The control lever unit 11C comprises a control lever 11*a* and a pari of potentiometers 11*d,* 11*e*. When the control lever 11*a* is turned downward to the left as viewed in the drawing, the potentiometer 11*d* outputs an electric signal Xa corresponding to a shift amount by which the control lever 11*a* has been operated. Conversely, when the control lever 11*a* is turned downward to the right as viewed in the drawing, the potentiometer 11*e* outputs an electric signal Xb corresponding to a shift amount by which the control lever 11*a* has been operated.

Further, the gate-lock lever 31 is connected to a lock signal generator 30C which does not operate when the gate-lock lever 11 is not manipulated, and operates upon the gate-lock lever 11 being manipulated by the operator, thereby outputting a lock signal (electric signal) Y.

The electric signals Xa, Xb from the potentiometers 11*d,* 11*e* and the lock signal Y from the lock signal generator 30C are input to a controller 50 which executes a predetermined arithmetic process based on those input signals and then outputs signals to proportional solenoid valves 51, 52, 53.

The proportional solenoid valves 51, 52, 53 are each a proportional solenoid valve for reducing the pilot primary pressure from the pilot pump 3 and outputting command pressure corresponding to the input signal. The command pressures from the proportional solenoid valves 51, 52 are applied to driving sectors 6*a,* 6*b* of the flow control valve 6, respectively. The command pressure from the proportional solenoid valve 53 is applied as, an external signal, to a regulator 22C.

The regulator 22C is of substantially the same structure as the regulator 22B in the third embodiment. The command pressure from the proportional solenoid valve 53 is input to a shift driving sector 22C*c* of a tilting control valve 22C.

Figure 11:
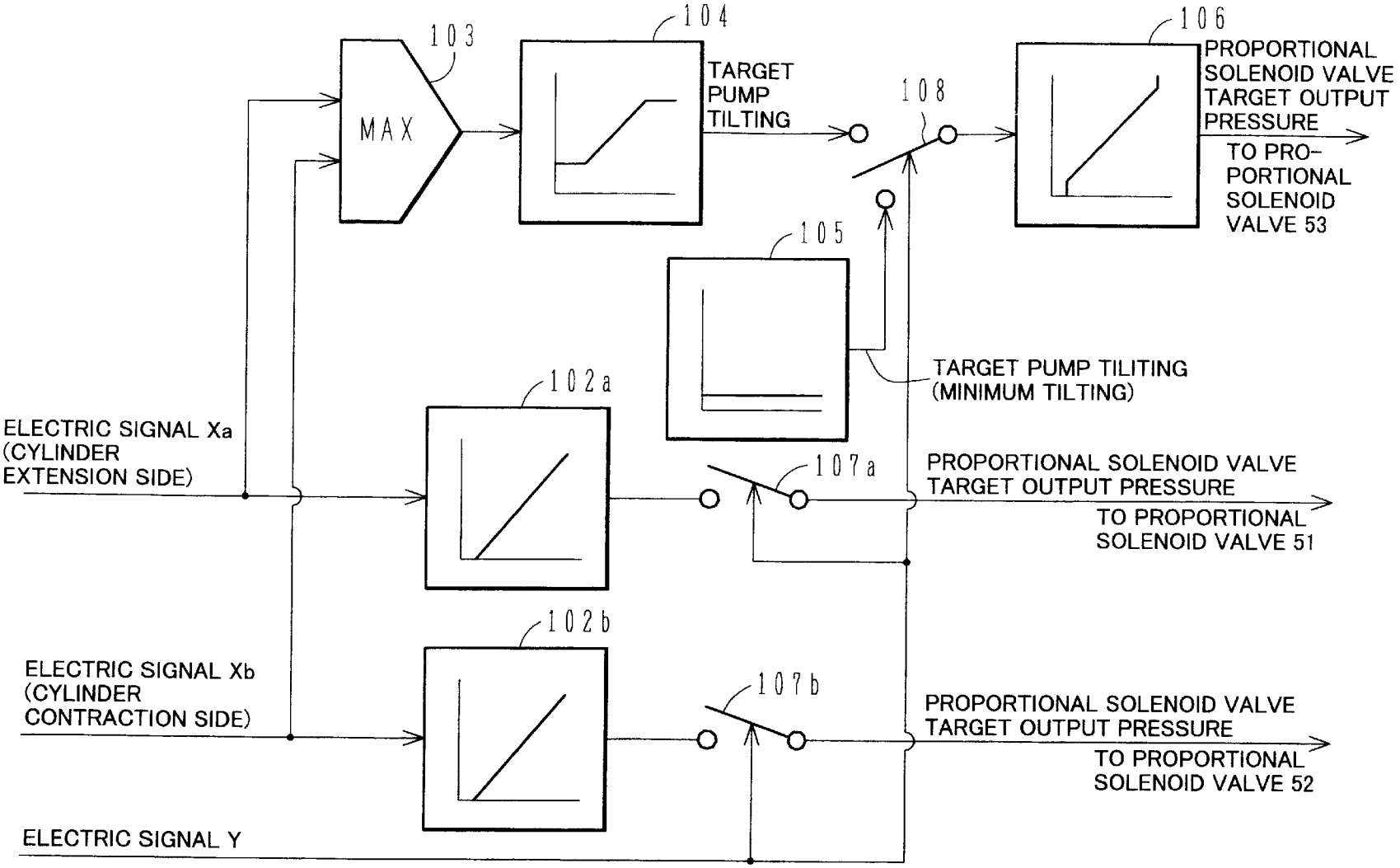
FIG. 11 is a functional block diagram showing a processing procedure of a controller.

FIG. 11 illustrates a processing procedure of the controller 50 in the form of a functional block diagram.

The controller 50 has functions of conversion tables 102*a,* 102*b* for shift amount—proportional solenoid valve target output pressure, a maximum value selector 103, a conversion table 104 for shift amount—target pump tilting, a target minimum tilting setting portion 105, a conversion table 106 for target pump tilting—proportional solenoid valve target output pressure, and lock switches 107*a,* 107*b,* 108.

Figure 12:
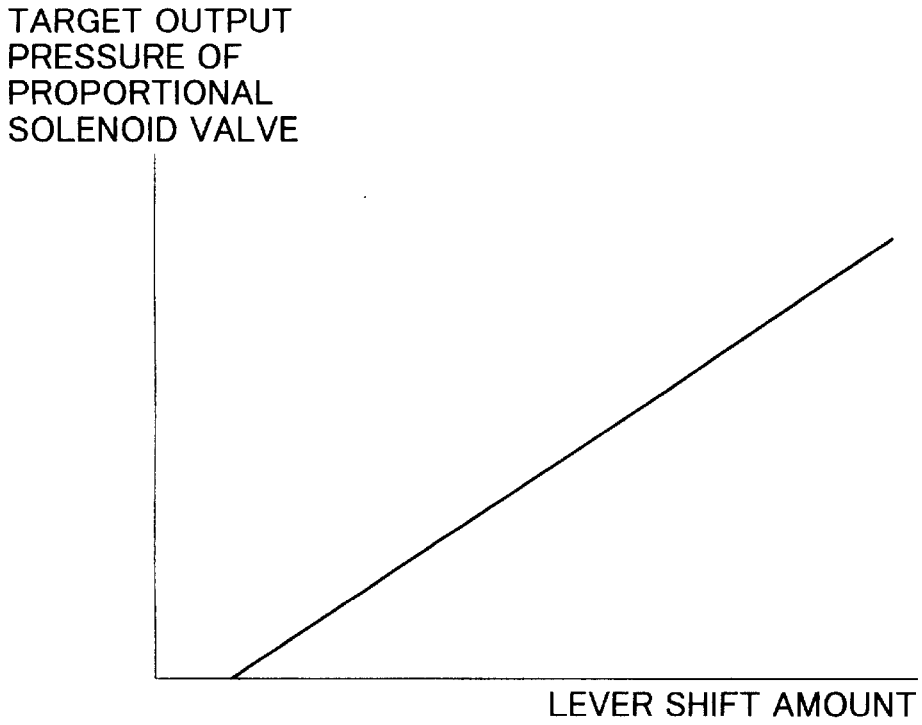
FIG. 12 is a graph showing the relationship between a lever shift amount and target output pressure of a proportional solenoid valve.

The conversion tables 102*a,* 102*b* for shift amount—proportional solenoid valve target output pressure receive the electric signals Xa, Xb and, based on a characteristic shown in FIG. 12, calculate target output pressures of the proportional solenoid valves 51, 52 corresponding to the shift amount of the control lever 11*a,* respectively.

As seen from FIG. 12, the target output pressure of each of the proportional solenoid valves 51, 52 is set to rise as the lever shift amount increases.

The maximum value selector 103 selects larger one the electric signals Xa, Xb. The conversion table 104 for shift amount—target pump tilting receives the selected electric signal and, based on a characteristic shown in FIG. 13, calculates a target pump tilting corresponding to the shift amount of the control lever 11*a.*

Figure 13:
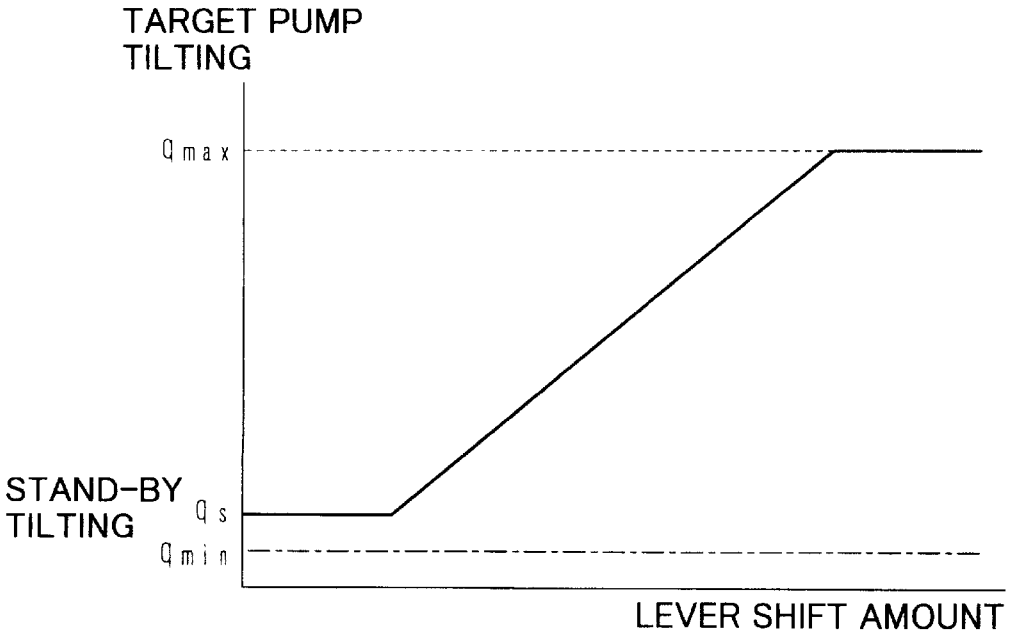
FIG. 13 is a graph showing the relationship between the lever shift amount and a pump tilting.

As seen from FIG. 13, the target pump tilting is set to become larger as the lever shift amount increases. Also, the target pump tilting corresponding to the lever shift amount resulted when the control lever 11*a* is in the neutral position, is set to a stand-by tilting $q_s$ which is slightly larger than the minimum tilting $q_{min}$ in the range achievable by the hydraulic pump 2.

The target minimum tilting setting portion 105 set therein the minimum tilting $q_{min}$ as a target pump tilting.

The lock switches 107*a,* 107*b,* 108 are each a switch which is turned off upon the lock signal Y turning on. When the lock signal Y is turned off, electric signals corresponding to the target output pressures calculated by the conversion tables 102*a,* 102*b* are output to the proportional solenoid valves 51, 52, and the target pump tilting calculated by the conversion table 104 is applied to the conversion table 106 for target pump tilting—proportional solenoid valve target output pressure.

Figure 14:
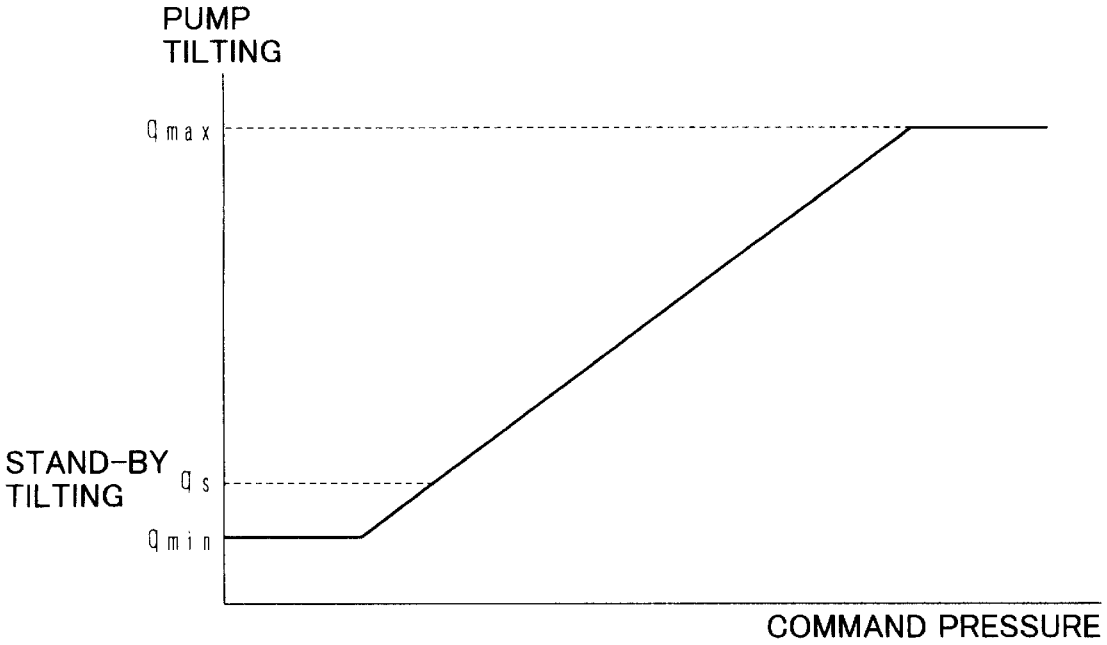
FIG. 14 is a graph showing the relationship between command pressure and the pump tilting.

In the conversion table 106 for target pump tilting—proportional solenoid valve target output pressure, the target pump tilting calculated by the conversion table 104 is converted into target output pressure of the proportional solenoid valve 53 based on a characteristic which is a reversal of the characteristic of the regulator 20C shown in FIG. 14, and an electric signal corresponding to the converted target output pressure is output to the proportional solenoid valve 53.

As seen from FIG. 14, the characteristic of the regulator 20C is one with which the pump tilting is controlled to increase as the command pressure rises, similarly to the characteristic of regulator 20B in the third embodiment.

On the other hand, when the lock signal Y is turned on, the lock switches 107*a,* 107*b,* 108 are turned off, the signals output to the proportional solenoid valves 51, 52 are made zero, and the input for the conversion table 106 is switched over to the target pump tilting from the target minimum tilting setting portion 105 (i.e., the minimum tilting $q_{min}$). The conversion table 106 converts the input target pump tilting into the target output pressure of the proportional solenoid valve 53 and outputs a corresponding electric signal to the proportional solenoid valve 53.

Also in this fourth embodiment having the above-described construction, when the gate-lock lever 31 is not manipulated, the lock switches 107*a,* 107*b,* 108 are kept turned on and therefore the operator can perform work in a normal way by manipulating the control lever 11*a.* But when the gate-lock lever 31 is manipulated, the lock switches 107*a,* 107*b,* 108 are turned off; hence the flow control valve 6 is disabled from operating not to move even if the control lever 11*a* is erroneously touched. At the same time, the input for the conversion table 106 is switched over to the target pump tilting from the target minimum tilting setting portion 105 (i.e., the minimum tilting $q_{min}$), whereupon the proportional solenoid valve 53 outputs the command pressure to the shift driving sector 22C*c* of the tilting control valve 22C for reducing the pump tilting down to the minimum tilting $q_{min}$. As a result, the spool 22C*a* of the tilting control valve 22C is forcibly moved to the right end position as viewed in the drawing under the action of the spring 22C*b*, causing the pump tilting to reduce down to the minimum tilting $q_{min}$.

With this fourth embodiment, therefore, the similar advantages as obtainable with the first and second embodiments can also be provided in the hydraulic circuit system in which command pressures applied to the flow control valve and the regulator are produced electrically.

The foregoing embodiments have been explained in connection with the regulators for the hydraulic pump which have an input torque limiting control function, a negative control function, or a positive control function solely. In usual cases, however, such regulators have an input torque limiting control function and a negative control function, or an input torque limiting control function and a positive control function in a combined manner. The present invention is also likewise applicable to a hydraulic circuit system including any of those regulators.

Figure 15:
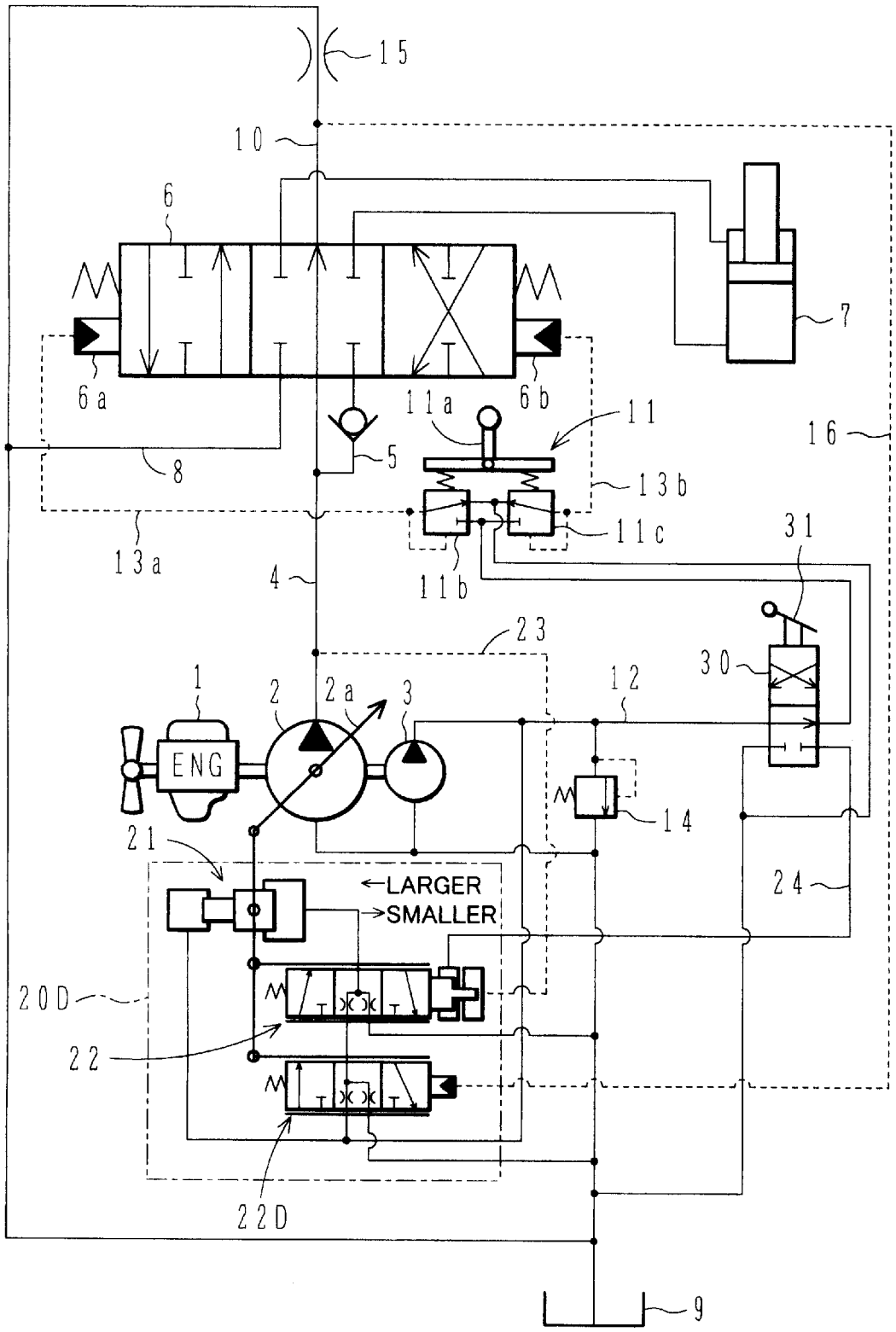
FIG. 15 is a diagram showing a hydraulic circuit system according to a fifth embodiment of the present invention.

FIG. 15 shows a fifth embodiment in which the present invention is applied to a hydraulic circuit system including a regulator which has an input torque limiting control function and a negative control function in a combined manner. In FIG. 15, the same members as those shown in FIGS. 1 and 3 are denoted by the same reference numerals. In this fifth embodiment, a regulator 20D has a tilting control valve 22 for input torque limiting control and a tilting control valve 22D for negative control. The tilting control valve 22 for input torque limiting control is arranged to operate in interlock with the lock valve 30 similarly to the first embodiment, and the tilting control valve 22D for negative control is the same as conventional.

Figure 16:
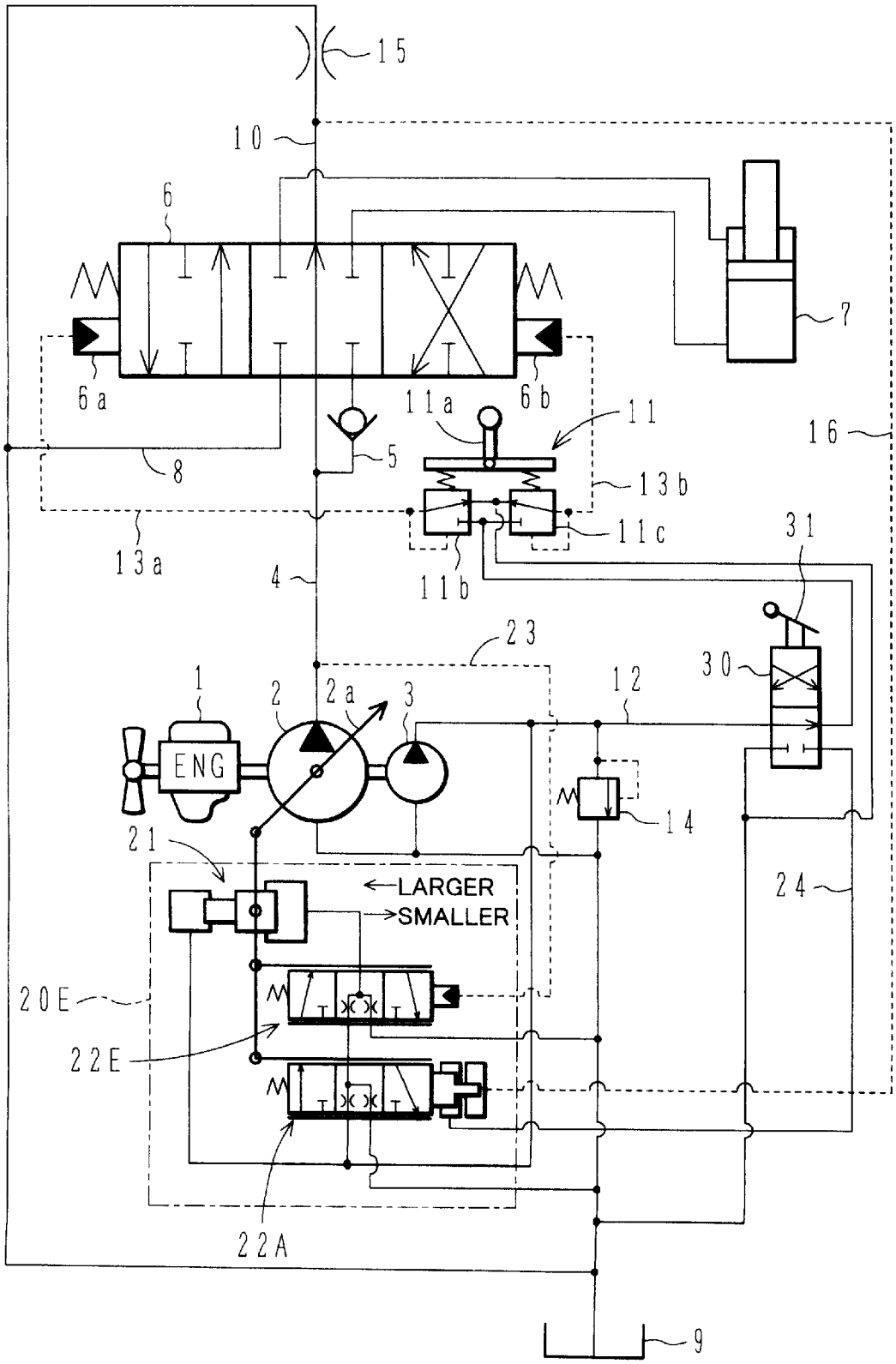
FIG. 16 is a diagram showing a hydraulic circuit system according to a sixth embodiment of the present invention.

FIG. 16 shows a sixth embodiment in which two tilting control valves are employed in a reversed manner to the relation in the above fifth embodiment. A tilting control valve 22A for negative control is arranged to operate in interlock with the lock valve 30 similarly to the second embodiment, and a tilting control valve 22E for input torque limiting control is the same as conventional.

Thus, in the hydraulic circuit system employing the regulator which has an input torque limiting control function and a negative control function in a combined manner, the present invention can be employed and the similar advantages can be obtained as with the first and second embodiments.

It should be understood that while the foregoing embodiments have been explained as operating the lock valve or the lock switch by the gate-lock lever, the present invention is not limited to that arrangement, but may be modified to operate the lock valve or the lock switch by any other suitable means such as a switch.

What is claimed is:

1. A hydraulic circuit system for a hydraulic working machine comprising a variable displacement hydraulic pump driven by a prime mover, first tilting control means for controlling the displacement of said hydraulic pump, a flow control valve for supplying and returning a hydraulic fluid from said hydraulic pump to and from an actuator, operation control means for driving said flow control valve to shift in position by a command signal, and safety control means provided in said operation control means selectively interrupting a generation/transmission path of said command signal, wherein:

said hydraulic circuit system further comprises second tilting control means for controlling the displacement of said hydraulic pump in interlock with the operation of said safety control means.

2. A hydraulic circuit system for a hydraulic working machine according to claim 1, wherein said second tilting control means reduces the displacement of said hydraulic pump in interlock with the operation of said safety control means.

3. A hydraulic circuit system for a hydraulic working machine according to claim 2, wherein said second tilting control means controls the displacement of said hydraulic pump in interlock with the operation of said safety control means to take a minimum value of the displacement in the range achievable by said hydraulic pump.

4. A hydraulic circuit system for a hydraulic working machine according to claim 1, wherein when the generation/transmission path of said command signal is cut off by said safety control means, said second tilting control means controls the displacement of said hydraulic pump to become smaller than the displacement provided by said first tilting control means when the generation/-transmission path of said command signal is not cut off and said flow control valve is in a neutral position.

5. A hydraulic circuit system for a hydraulic working machine according to claim 1, wherein said first tilting control means reduces the displacement of said hydraulic pump as delivery pressure of said hydraulic pump rises, and said second tilting control means controls the displacement of said hydraulic pump in interlock with the operation of said safety control means to become smaller than the displacement provided by said first tilting control means when the delivery pressure of said hydraulic pump is at the lowest level.

6. A hydraulic circuit system for a hydraulic working machine according to claim 1, wherein said first tilting control means controls the displacement of said hydraulic pump in accordance with a flow rate demanded by said flow control valve and, when said flow control valve is in a neutral position, controlling the displacement of said hydraulic pump to provide a stand-by flow rate larger than a minimum flow rate of said hydraulic pump, and said second tilting control means controls the displacement of said hydraulic pump in interlock with the operation of said safety control means to become smaller than the displacement at which said stand-by flow rate is provided.

7. A hydraulic circuit system for a hydraulic working machine according to claim 1, wherein said operation control means is pilot-operated means for producing command pilot pressure, as said command signal, by using pressure from a pilot hydraulic pressure source as primary pressure, and said safety control means comprises a gate-lock lever to be manipulated when an operator has no intention of carrying out work, and a lock valve operated upon said gate-lock lever being manipulated by the operator, for cutting off the primary pressure from said pilot hydraulic pressure source.

* * * * *